US007063476B1

(12) United States Patent
Pinnix et al.

(10) Patent No.: US 7,063,476 B1
(45) Date of Patent: Jun. 20, 2006

(54) LIQUID DISPENSING APPLICATOR

(75) Inventors: Verna M. Pinnix, 7791 U.S. Highway 64 East, Ramseur, NC (US) 27316; Thomas G. Pilcher, II, 2901 Nina Ct., Raleigh, NC (US) 27603

(73) Assignees: Verna M. Pinnix; Thomas G. Pilcher, II; Marion S. Pilcher

( * ) Notice: Subject to any disclaimer, the term of this patent is extended or adjusted under 35 U.S.C. 154(b) by 0 days.

(21) Appl. No.: 10/757,941

(22) Filed: Jan. 16, 2004

(51) Int. Cl.
*B05C 1/06* (2006.01)

(52) U.S. Cl. ..... 401/264; 401/273

(58) Field of Classification Search ..... 401/176, 401/180, 181, 270, 272, 273, 278, 264, 60
See application file for complete search history.

(56) References Cited

U.S. PATENT DOCUMENTS

| | | | | |
|---|---|---|---|---|
| 2,206,208 | A * | 7/1940 | Thomas | 401/148 |
| 2,995,768 | A | 8/1961 | Skuratowicz | |
| 3,103,682 | A | 9/1963 | Markle | |
| 3,463,302 | A | 8/1969 | Preston | |
| 4,077,725 | A | 3/1978 | Slautterback | |
| 4,299,005 | A | 11/1981 | Brown | |
| 4,483,636 | A | 11/1984 | Meyer | |
| 4,826,340 | A | 5/1989 | Rothweiler et al. | |
| 4,971,227 | A * | 11/1990 | Knickerbocker et al. | 222/153.07 |
| 5,088,849 | A | 2/1992 | Johnson et al. | |
| 5,240,339 | A | 8/1993 | DeForest et al. | |
| 5,454,659 | A | 10/1995 | Vosbikian et al. | |
| 5,671,497 | A | 9/1997 | Abdo | |
| 5,823,206 | A | 10/1998 | Mapleback | |
| 5,851,077 | A | 12/1998 | Trejo | |
| 5,931,591 | A | 8/1999 | McCracken | |
| 5,991,961 | A | 11/1999 | Zurik | |
| 6,009,887 | A | 1/2000 | Hertel | |
| 6,129,469 | A | 10/2000 | Messer et al. | |
| 6,409,406 | B1 | 6/2002 | Schwartzman | |
| 6,425,701 | B1 | 7/2002 | Jacobs | |
| 2005/0144786 | A1 * | 7/2005 | Bressler et al. | 30/41 |

* cited by examiner

*Primary Examiner*—Justine R. Yu
*Assistant Examiner*—Peter deVore
(74) *Attorney, Agent, or Firm*—Womble Carlyle Sandridge & Rice, PLLC; C. Robert Rhodes; Lewis S. Rowell

(57) ABSTRACT

A dispensing applicator for applying liquid to the skin, comprising a handle having an internal reservoir for containing a liquid, a head having an applicator portion, and a liquid delivery mechanism interconnecting the reservoir of the handle to the applicator portion of the head, and operative responsive to pivotal movement of the handle to deliver liquid from the reservoir to the applicator portion when the applicator portion is positioned against a user's skin.

5 Claims, 6 Drawing Sheets

LIQUID DISPENSING APPLICATOR

FIELD OF THE INVENTION

The present invention relates to the field of liquid applicators, and, more particularly to devices for dispensing and applying liquids, such as skin care lotions or oil, onto the back and other parts of the body that are ordinarily difficult to reach.

BACKGROUND OF THE INVENTION

Recent years have seen the advent of a variety of oil, soap, and lotion applicators. In particular, a number of these devices have incorporated built-in or attached liquid reservoirs so that users can dispense and apply a liquid more conveniently. There have also been developed several applicators to assist a person in applying lotions and the like to areas of the body, such as the back, that are difficult to reach.

While long-handled brushes and applicators that are directed to dispensing and applying various types of liquids are known in the art, these prior art devices have several shortcomings that have negatively offset their utility. For example, most of these devices lack any effective means for regulating and stopping the flow of lotion or other liquid onto the brush or sponge applicator. As a result, excessive liquids are often dispensed which leads to undesirable leakage, often spoiling clothing or other items with which they are in contact. Still further, uncontrolled dispensing of the liquid can cause running of the liquid when the applicator is placed in contact with the skin, frustrating the user and wasting the liquid.

Another problem inherent in these prior art devices is the difficulty with which liquid is dispensed to the applicator. Most of the devices must be "squeezed" against the skin to dispense the liquid. For aged and handicapped users, these devices have proven extremely difficult, if not impossible, to use. One attempted solution to this problem has been to incorporate levers or buttons into the handles of these devices to force the liquid from the reservoir and onto the applicator sponge or head. Again, however, once activated, there is no way to stop the flow of liquid until the pressure in the reservoir diminishes. Also, because these devices require some degree of strength and dexterity, many aged and handicapped persons have not been able to use them.

SUMMARY OF THE INVENTION

The present invention is directed to a dispensing applicator for applying a liquid, such as lotion, to the skin and that overcomes the problems of the applicators and dispensers of the prior art.

In one embodiment, the dispensing applicator comprises a head, a handle, and a liquid delivery mechanism. The head includes a base portion and an applicator portion. As will be explained in greater detail below, the applicator portion is pivotally connected to one end of the base portion to facilitate ease of manipulation in dispensing liquid to the surface of the skin. As used herein, the applicator portion refers to that part of the head that is intended for contact with the user's skin. A fluid outlet is formed through the applicator portion so that the lotion, or other liquid, is easily dispensed directly to the user's skin. In one preferred embodiment, the applicator portion further includes a substantially planar applicator pad that is adapted for rubbing liquids onto the surface of the skin. One such pad is formed of a soft rubber that is not harmful to sensitive skin.

The handle of the dispensing applicator is substantially hollow and comprises a reservoir for containing the liquid to be dispensed. The handle includes a free end that is capped, and a fixed end that is interconnected to and in fluid communication with the base portion of the head. The handle is of sufficient length and shape to permit a user to grasp the free end and reach remote portions of the body, such as the back, with the applicator without undue exertion. The free end of the handle may optionally include a rubber, or other non-slip, grip.

In one embodiment, the handle comprises at least two hollow sections. One of the sections is substantially straight, while the other has an arcuate portion. Ergonomically, this permits the user to apply the applicator to the skin without having to bend or strain. In a second embodiment, one section of the handle is substantially straight and the other has an angled portion. The two sections of the handle are detachably connected via male and female threaded connections. This detachable connection serves two functions: (1) it provides a means for supplying lotion to the hollow reservoir, and (2) it permits the dispensing applicator to be "broken down" for compact storage when the user is traveling, or the like. A separate cap may be provided to allow the filled reservoir section to be transported without spilling.

The liquid delivery mechanism is disposed substantially within the head of the dispensing applicator and interconnects the reservoir of the handle to the applicator portion of the head. In one embodiment, the liquid delivery mechanism comprises a spring-actuated pump. One such pump is a conventional reciprocating piston pump. The spring of the pump functions to bias the pump in a closed position, whereby liquid is prevented from flowing to the applicator portion when the applicator is not in use. Further, the pump biases the base portion of the head away from the applicator portion. In use, when the applicator portion is positioned against a user's skin and pressure is exerted downward on the handle in the direction of the user's skin, the applicator portion pivots, depressing the spring-actuated pump, causing liquid to be dispensed by the pump from the reservoir to the applicator portion of the head.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
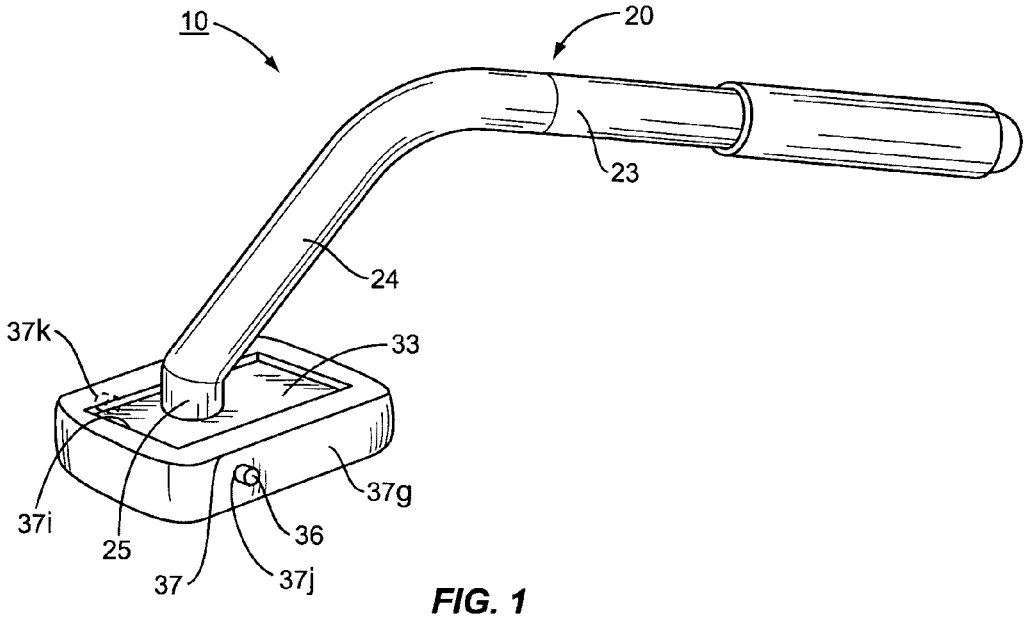
FIG. 1 is a top perspective view of the liquid applicator dispenser of the present invention.
Figure 2:
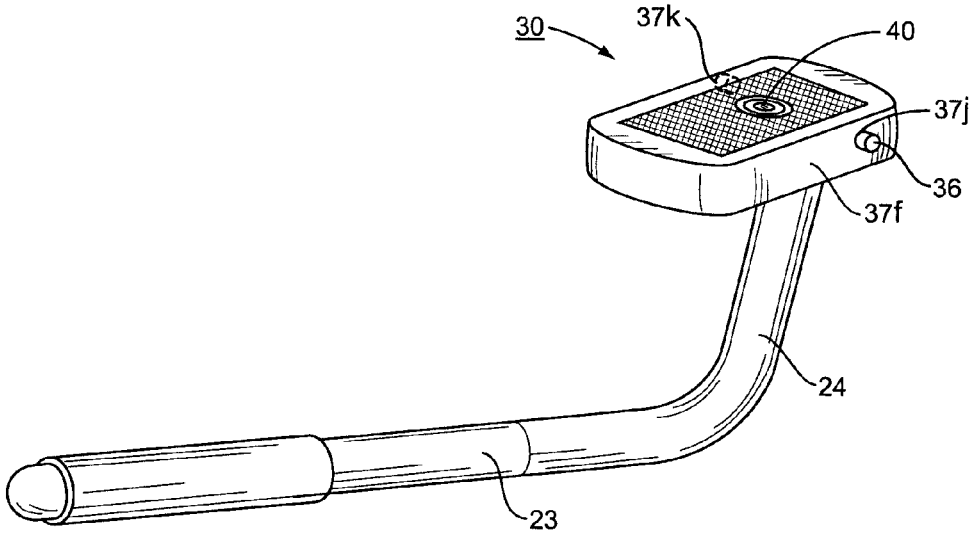
FIG. 2 is a bottom perspective view of the dispenser of FIG. 1.

Referring now to FIGS. 1 and 2, the present invention is directed to a dispensing applicator for applying a liquid, such as lotion or oil, to the skin. Shown generally as 10, the dispensing applicator, in its simplest construction, comprises an elongated handle 20, a head 30, and a liquid delivery mechanism 40.

Figure 3:
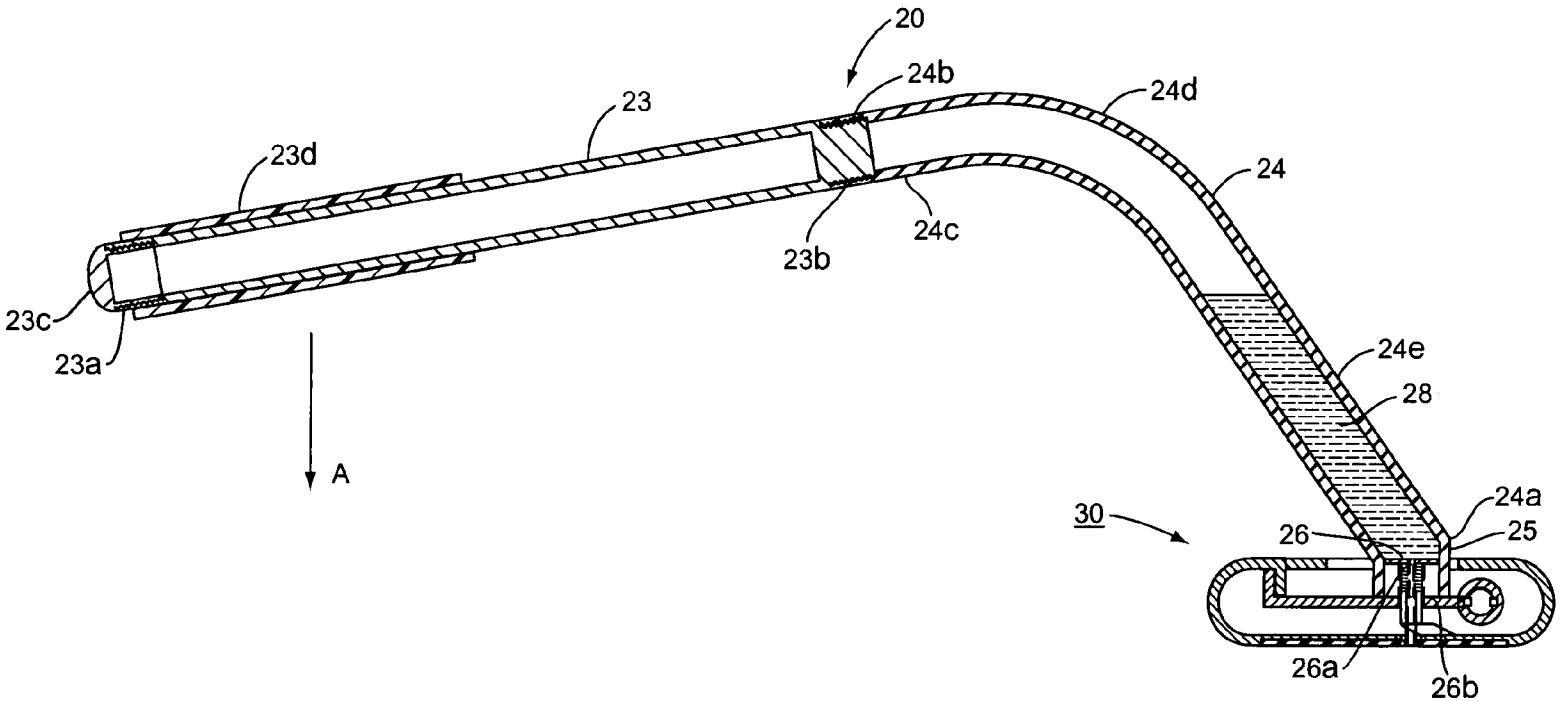
FIG. 3 is a cross-sectional view of the dispenser of FIG. 1.

Referring also to FIG. 3, in one preferred embodiment the elongated handle 20 comprises two detachably connected sections, handle portion 23 and reservoir portion 24. The handle portion 23, which has a free end 23*a*, serves as the gripping portion of the dispensing applicator 10. The handle portion 23 is a substantially straight hollow tube that is constructed from a lightweight plastic. Although there are numerous suitable plastics, and composite materials that would provide a suitable durable construction, acetal-type plastics, or polycarbonate plastics are quite suitable and readily available commercially. Further, as one objective of the present invention is to provide an economical construction, tubing formed from these plastics is also relatively inexpensive. A cap 23*c* is affixed over the free end 23*a* of the handle portion 23 to seal the free end 23*a* so that liquid contained in the reservoir portion 24 will not pour out. Alternatively, other forms of seals or plugs may be placed within the hollow handle section 23 at some point along its length to prevent fluid loss. Optionally, a grip 23*d*, such as a contoured rubber tube, is fitted over the handle section 23 toward the free end 23*a*. The grip 23*d* may be either pressure fitted, or adhered to the handle section 23 with a commercially available waterproof epoxy.

At the opposite end of the handle portion 23 is a male threaded connector 23*b* formed in the tubing. This threaded connector 23*b* permits a user to easily thread the handle portion 23 into the threaded female connector 24*b* of the reservoir portion 24 of the handle 20. As those skilled in the art will appreciate there is no significance as to which of the two portions, handle 23 or reservoir 24, is male or female. Alternatively, instead of threaded connections, the handle 20 construction could comprise friction fit connections. Although the entire handle 20 could be used as a reservoir, only the reservoir portion 24 is needed to hold the liquid 28, as it would not be practical to fill both portions 23, 24, and risk spilling the lotion when assembling and disassembling the applicator 10. Thus, the reservoir portion 24 is sized so that it will hold enough liquid for several applications.

Figure 4:
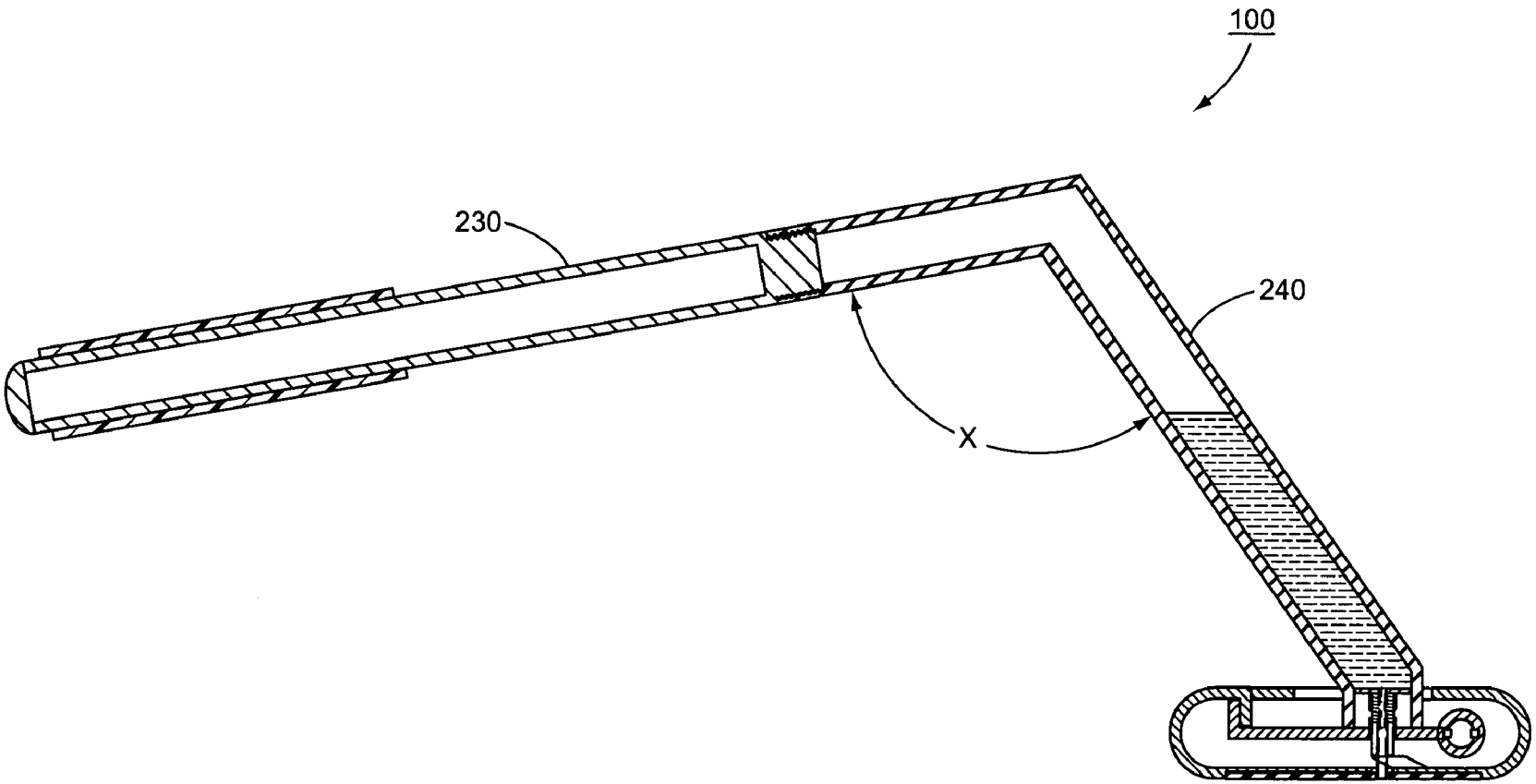
FIG. 4 is a view of an alternative embodiment of the handle of the dispenser of the present invention.

The reservoir portion 24 of the handle 20 is desirably constructed of the same hollow plastic tubing as the handle portion 23. From the threaded connector 24*b*, the reservoir portion 24 comprises a short straight section 24*c* of hollow tubing, a downward turning arcuate section 24*d*, and then another straight section 24*e* that extends downward to the end 24*a* of the reservoir. The two straight sections 24*c* and 24*e* form an obtuse angle with respect to one another. It has been found that an angle of between about 90 degrees and 140 degrees is optimal, with an angle of about 115 degrees being preferred. In relationship to the head 30, the straight section 24*e* forms an acute angle with respect to the upper surface of the head 30. It has been found that when the straight sections form such an obtuse angle, straight section 24*e* preferably forms an angle of between about 30 degrees and 70 degrees with the upper surface of the head 30, and desirably about 55 degrees. Alternatively, and as shown in FIG. 4, another embodiment of the dispensing applicator 100 could be comprised of a substantially straight handle portion 230, and a reservoir portion 240 having two substantially straight lengths in angled relation with one another. The angle designated as 'x' in FIG. 4 will also be between about 90 degrees and 130 degrees, with an angle of about 115 degrees being preferred.

The open end 24*a* of the reservoir section 24 is joined to a short, vertical section 25 of tube of the same diameter. Thus, section 24*d* extends downward at an angle toward the head 30 and is joined with vertical section 25 which extends downward at substantially a right angle to the upper surface of the head 30. End 24*a* and tube 25 are joined together with a commercially available waterproof epoxy. Alternatively, section 25 may be integrally formed with the reservoir portion 24. Mounted within the upper portion of the vertical section is a durable plastic, disc-shaped insert 26. Insert 26 functions as the bottom of the reservoir. This insert 26 is bonded to the inner walls of the tube 25 with waterproof epoxy. The orifice 26*a*, sized to mate with the pump inlet, is formed through the insert 26. The insert 26 and orifice 26*a* arrangement thus serves to seal the end of the reservoir and interconnects the liquid delivery mechanism 40, described hereinbelow, to the head 30 of the dispensing applicator 10. As will be appreciated by those skilled in the art, the diameter of the orifice, and hence, of the intake 40*a* of the liquid delivery mechanism 40, will depend upon the type of fluid 28 anticipated for use in the dispensing applicator.

Figure 5:
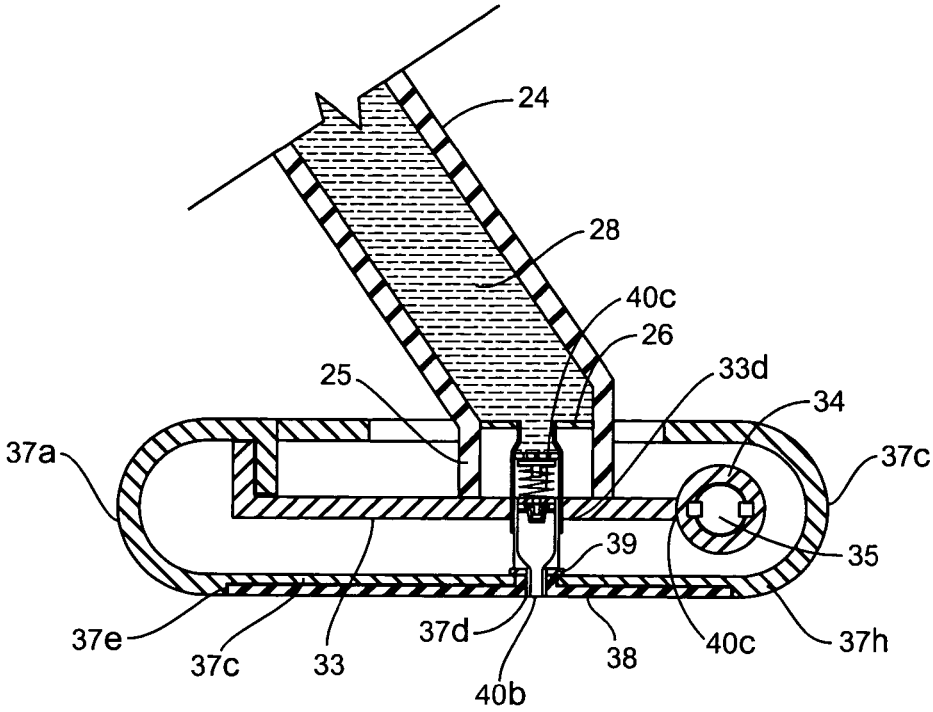
FIG. 5 is a cross-sectional view of the head of the dispenser of the present invention is a relaxed position.

The head 30 of the dispensing applicator 10 comprises a base portion 33 and an applicator portion 37. As best shown in FIGS. 1 and 5, the base portion 33 comprises a substantially rectangular connector plate 33*a* that is connected to the bottom end 25*b* of the vertical tube section 25. Again, end 25*b* and the connector plate 33*a* are joined with a commercially available waterproof epoxy, or alternatively, are integrally formed. Connector plate 33*a* is also constructed of a durable plastic. As will be understood hereinbelow, the connector plate is shorter and narrower than the applicator portion 37. A horizontally oriented hollow plastic cylinder 34 is adhesively bonded to edge 33*b* of the connector plate 33. At the opposed end of the connector plate is a vertical stop 33*c* which will function to maintain the head 30 in the relaxed position when the dispensing applicator is either not in use or when the user is simply rubbing the liquid 28 onto the skin. A circular orifice 33*d* is formed through the connector plate 33 and is dimensioned to approximate the diameter of the liquid delivery mechanism 40 to be mounted therein.

As best seen in FIGS. 2 and 5, the applicator portion 37 of the head 30 is generally rectangular with sides and ends that define a box-like structure, with a partially open top 37*i*. For comfort to a user, the opposed ends 37*a*, 37*b* of the applicator portion are slightly rounded so that a user will not be harmed when rubbing the applicator portion 37 against the skin. The applicator surface 37*c* is substantially planar and rectangular. An orifice 38 is formed through the applicator surface 37*c* to interconnect to the liquid delivery mechanism 40 to permit discharge of the liquid 28 from the liquid delivery mechanism 40 onto the surface the user's skin. Optionally, an applicator pad 38 is affixed to the applicator surface 37*c* to provide a soft rubbing surface for contact with the skin so that the dispensed liquid 28 can be rubbed into the skin. Desirably, the applicator pad 38 is formed as a sheet of non-absorbing and non-reactive rubber. One suitable rubber is USP Class XI EPDM rubber which is an FDA-approved rubber that is suitable for contact with sensitive skin. As shown in FIG. 5, the applicator pad may be fitted into a recess 37*e* formed in the application surface 37*c*. Any epoxy that is compatible with both rubber and plastic may be used to adhere the pad 38 to the surface 37*c* of the applicator portion 37.

The base portion 33 and the applicator portion 37 are connected together about a pivot point 35. The base portion 33 is dimensioned to fit through the open top 37*i* of the applicator portion 37. A pin 36, or rod, is inserted through the slots 37*j*, 37*k* in walls 37*f* and 37*g* of the applicator portion 37 and extends through the length of the hollow plastic cylinder 34. The pin 36 may be dimensioned with grooves formed around the circumference of the pin 36 at opposed ends to engage the walls 37*f* and 37*g* so that the rod remains in place. Alternatively, other fasteners, such as bolts or the like may be used to pivotally connect the portions 33, 37 together.

Figure 7:
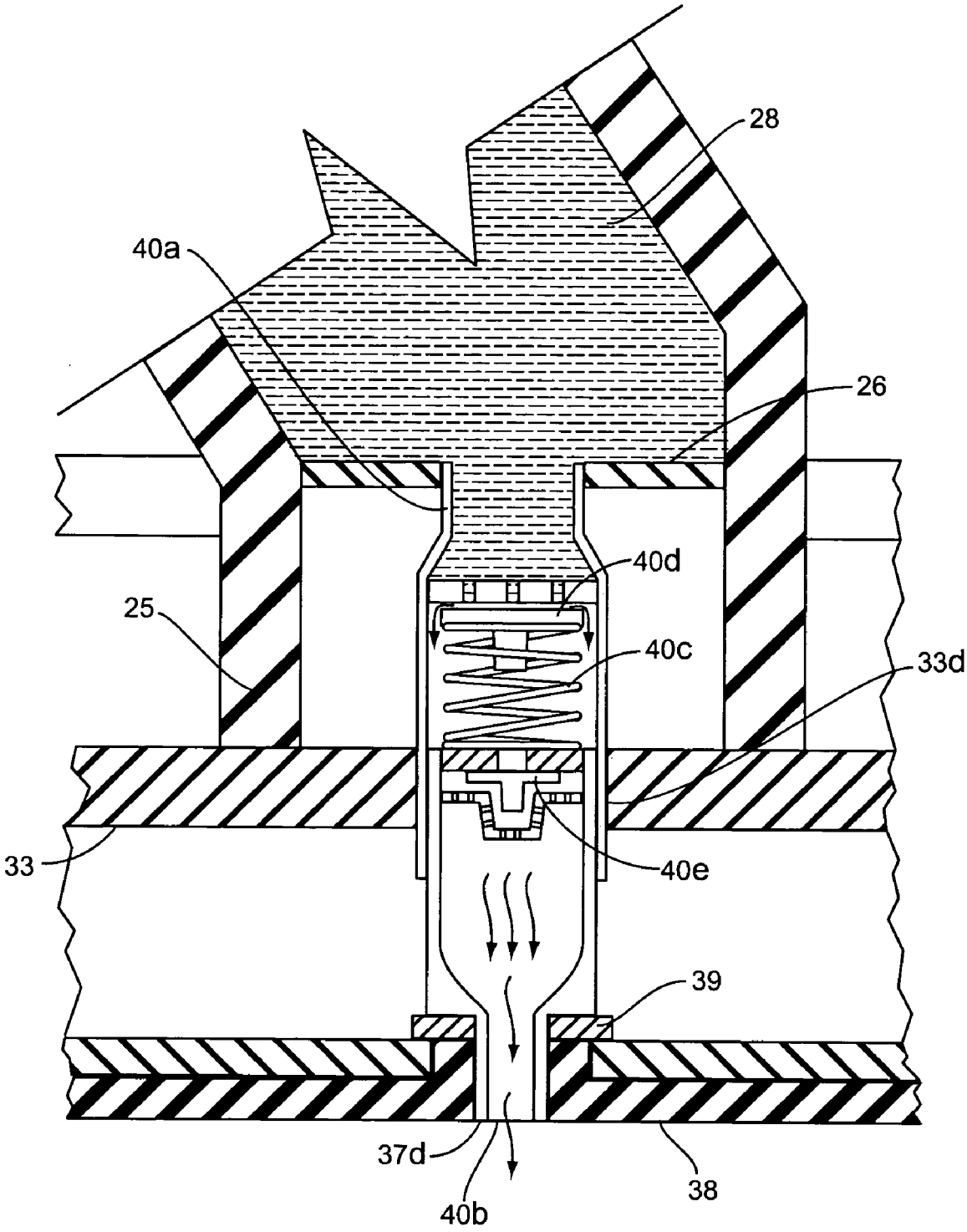
FIG. 7 is an enlarged detailed view of one embodiment of a piston pump for dispensing liquid.

One preferable mechanism 40 for moving liquid 28 from the reservoir portion 24 and delivering it to the surface of the user's skin, is a commercially available reciprocating piston pump, shown in detail in FIG. 7. As those skilled in the art will appreciate, such a pump conventionally comprises two one-way valves 40*d*, 40*e* in the pumping system: one 40*d* between the reservoir portion 24 and the pump chamber and one 40*e* between the pump chamber and the nozzle, or discharge, end of the pump. For a vertically oriented design, a piston is disposed within the pump chamber in contact with the discharge end of the pump. When pressure is exerted on the spring-actuated discharge end, compressing the spring 40*c*, the one-way valve 40*e* between the pump chamber and the discharge end is unseated and the piston is pushed into the chamber. As the piston is pushed into the chamber, the volume of the chamber decreases, forcing liquid around the displaced one-way valve and out of the nozzle. This inward pressure of the piston forces the other one-way valve 40*d* to remain seated. When pressure is removed from the spring-actuated discharge end, the spring forces the piston to retreat from the pump chamber and causes the one-way valve 40*e* to reseat, sealing the nozzle. The increase in volume in the pump chamber creates a vacuum which unseats the one-way valve 40*d* at the reservoir portion 24 and draws liquid into the pump chamber. This completes one pump cycle.

One suitable pump (1–2 ml volume) is available from Pfeiffer, GmbH. The intake stem 40*a* of the pump 40 is in liquid communication with the reservoir portion 24 through the restrictive flow orifice 26*a*. The pump 40 is securely mounted in opening 33*d* in the connector plate 33. When activated the pump 40 withdraws liquid 28 from the reservoir section 24 of the handle and dispenses it from the discharge stem 40*b*, through orifice 37*d* in the applicator surface and onto the user's skin. As is conventional, this type of pump is comprised of a fluid inlet, a flow-limiting check valve, a plunger or piston, and a flexible fluid discharge stem. The discharge stem is flexible so that it can bend as the head of the device pivots.

Figure 6:
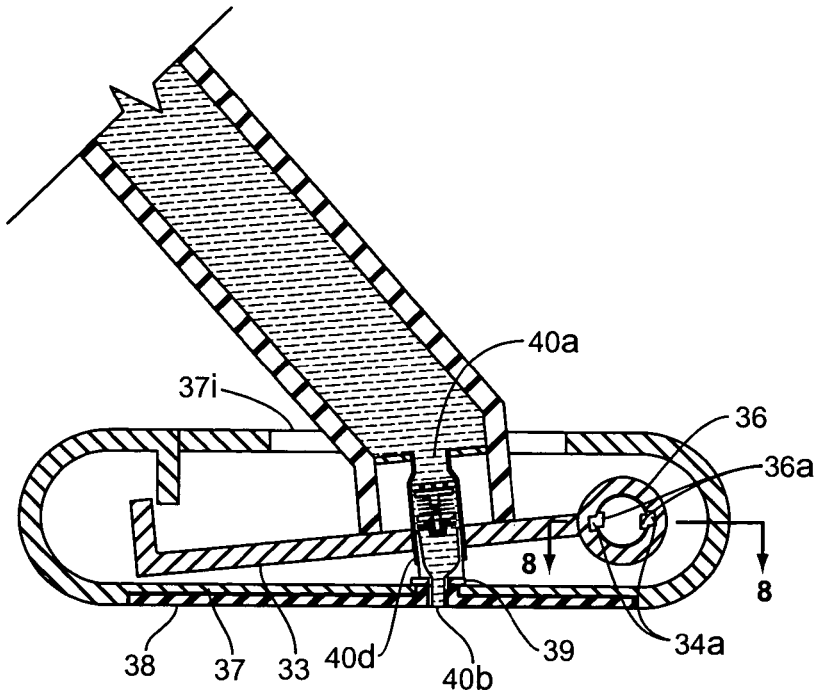
FIG. 6 is a cross-sectional view of the head of the dispenser of the present invention in a depressed position.

Turning now to FIGS. 3, 5, and 6, the operation of the present invention is illustrated. With liquid 28 in the reservoir section 24, the above described dispensing applicator 10 is ready for use. A user will grasp the handle portion 23 of the dispensing applicator by grip 23*d* and place the applicator surface 37*c* head 30 against the desired skin area. The user will then apply a pivotal pressure in the direction of Arrow 'A'. This pivotal pressure causes the base portion 33 to pivot downward about pivot point 35. In one preferred embodiment, at least one lifting lever 39 is attached to the inner surface 37*h* of the applicator portion 37. The lifting levers 39 project upward to engage the bottom flange 40*d* of the pump 40, thereby compressing the spring 40*c*. This compression of the spring 40*c* causes the pump to dispense a fixed volume of liquid 28 to the applicator pad 38. As best shown in FIG. 6, the discharge stem 40*b* of the pump 40 is desirably flexible to allow for between about 5 degrees and 10 degrees of tilt during compression of the spring 40*c*, without altering the performance of the pump 40. When the user relaxes the pressure on the handle 23, the spring 40*c* will return to a relaxed position, as shown in FIG. 5, and a new volume of liquid is withdrawn from the reservoir 24 through the intake stem 40*a* of the pump 40. When the pressure on the spring is relaxed, the base 33 and applicator 37 will return to their starting positions relative to one another (see Arrow 'B'). The stop 33*e* will come to rest against the upper inner surface 37*k* of the applicator portion 37. Once relaxed, additional liquid is prevented from flowing from the reservoir 24, so that leakage and running are prevented. The user can then repeat the action to dispense additional liquid 28, as desired, or can use lateral rubbing motions to apply the liquid 28 to the skin.

Figure 8:
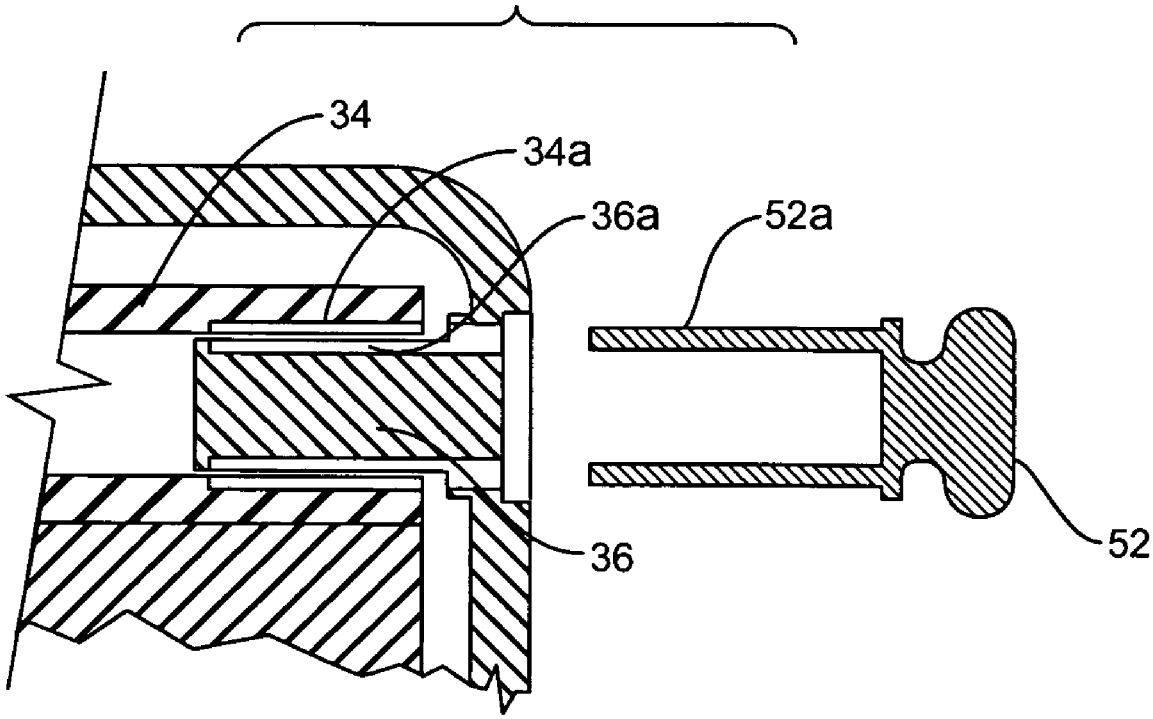
FIG. 8 is a cross-sectional exploded view of the pin and cylinder locking arrangement taken along Line 8—8 of FIG. 6.

To facilitate storage, or for convenience during travel, the dispensing applicator 10 may be partially disassembled. The two handle portions 23 and 24 are easily uncoupled and a threaded cap (not shown) may be inserted into the threaded connection 24*b* of the reservoir portion 24 to seal any unused liquid 28 in the reservoir portion 24. Optionally, longitudinal grooves 34*a* may be formed in the walls of the hollow cylinder 34 to match corresponding longitudinal grooves 36*a* formed in the surface of the pin 36. As illustrated in FIG. 8, a fork-like insert 52 having tines 52*a* can then be inserted into the aligned grooves 34*a*, 36*a* to prevent pivotal movement of the base 33 and applicator 37 sections.

Although the present invention has been described with exemplary constructions, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A dispensing applicator for applying liquid to the skin, comprising:

(a) a handle having:

(i) a base portion;

(ii) a self-contained internal reservoir for containing a liquid, wherein the handle is elongated for extended reaching and is closed at one end and terminates at the base portion;

(b) a head having a housing and an applicator portion;

(c) the base portion being pivotally connected to the housing; and (d) a pump interconnecting the reservoir of the handle to the applicator portion of the head and operative responsive to unidirectional, pivotal movement of the handle about a fixed axis spaced apart from the pump to deliver liquid from the reservoir to the applicator portion by compression of the pump against a pivoting surface internal to the head when the applicator portion of the head is positioned against a user's skin, and the handle is pivotally operated to dispense the liquid and return the head to its original fixed position following the pumping action.

2. The applicator of claim 1 wherein the reservoir of the handle is in liquid communication with the base portion of the head.

3. The applicator of claim 1 wherein the head further comprises a locking mechanism, the locking mechanism to prevent pivotal movement of the base portion with respect to the applicator portion.

4. The applicator of claim 1 wherein the applicator portion is pivotally biased away from the base portion by the pump.

5. The applicator of claim 1 wherein the pump is a reciprocating piston pump.

* * * * *